US009079675B2

(12) United States Patent
Vervoort et al.

(10) Patent No.: US 9,079,675 B2
(45) Date of Patent: Jul. 14, 2015

(54) DUAL PURPOSE SCREW COUPLING PIECE

(75) Inventors: Bart Vervoort, Poederlee (BE); Peter Gebois, Aartselaar (BE); Marc Hermans, Leopoldsburg (BE); Gabor Fazekas, Budapest (HU)

(73) Assignee: Soudal, Turnhout (BE)

( * ) Notice: Subject to any disclaimer, the term of this patent is extended or adjusted under 35 U.S.C. 154(b) by 97 days.

(21) Appl. No.: 13/701,854

(22) PCT Filed: May 30, 2011

(86) PCT No.: PCT/EP2011/058858

§ 371 (c)(1), (2), (4) Date: Mar. 15, 2013

(87) PCT Pub. No.: WO2011/151295

PCT Pub. Date: Dec. 8, 2011

(65) Prior Publication Data

US 2013/0167976 A1 Jul. 4, 2013

(30) Foreign Application Priority Data

Jun. 4, 2010 (EP) ..... 10164924

(51) Int. Cl.

| | |
|---|---|
| ***B65D 83/00*** | (2006.01) |
| ***B65B 1/04*** | (2006.01) |
| ***B65D 83/20*** | (2006.01) |
| ***B65D 83/22*** | (2006.01) |
| ***B65D 83/46*** | (2006.01) |
| *B05B 9/08* | (2006.01) |
| *B65D 83/30* | (2006.01) |
| *B65D 83/38* | (2006.01) |

(52) U.S. Cl.

CPC ..... *B65B 1/04* (2013.01); *B65D 83/201* (2013.01); *B65D 83/226* (2013.01); *B65D 83/46* (2013.01); *B05B 9/0805* (2013.01); *B65D 83/202* (2013.01); *B65D 83/303* (2013.01); *B65D 83/38* (2013.01)

(58) Field of Classification Search

CPC .... B65D 83/201; B65D 83/345; B65D 83/28; B65D 3/46; B65B 1/04

USPC ..... 222/402.1, 402.11

See application file for complete search history.

(56) References Cited

U.S. PATENT DOCUMENTS

| | | | | |
|---|---|---|---|---|
| 4,453,650 | A * | 6/1984 | Witte et al. | 222/43 |
| 5,027,986 | A * | 7/1991 | Heinzel et al. | 222/402.24 |
| 5,549,228 | A * | 8/1996 | Brown | 222/570 |
| 2007/0181610 | A1 * | 8/2007 | Fazekas et al. | 222/402.11 |
| 2009/0145928 | A1 * | 6/2009 | De Laforcade | 222/153.11 |
| 2013/0062369 | A1 * | 3/2013 | Engel et al. | 222/402.15 |

* cited by examiner

*Primary Examiner* — Paul R Durand
*Assistant Examiner* — Jeremy W Carroll
(74) *Attorney, Agent, or Firm* — Jerold I. Schneider; Schneider Rothman IP Law Group PLLC

(57) ABSTRACT

A dual purpose coupling piece is provided for on the one hand the screw coupling of a disposable pressure container with a dispensing gun, and which further includes means for on the other hand also cooperating in a bayonet-type coupling with a suitable handheld applicator for application of the compound as in the handheld use. A suitable handheld applicator is also provided. The coupling piece and/or the handheld applicator may be designed for the production as one single product using injection moulding. Further provided is an assembly of a container with the coupling piece, and a process for producing the coupling piece and the assembly, as well as the handheld applicator.

12 Claims, 9 Drawing Sheets

DUAL PURPOSE SCREW COUPLING PIECE

CROSS-REFERENCE TO RELATED APPLICATIONS

This application is the entry into the United States of PCT Application Number PCT/EP2011/058858 filed May 30, 2011 and claims priority from European Patent Application Number EP/10164924.2 filed Jun. 4, 2010, the entirety of each of which are hereby incorporated by reference.

FIELD OF THE INVENTION

The current invention relates to containers, cans or canisters containing a compound under pressure, in particular disposable containers, and which can be coupled to a device, typically called a dispensing gun, for applying the compound. The compound is usually reactive or curable, may thus comprise one or more active components, and may be suitable to form for example a sealant (e.g. a silicone paste), a polyurethane (PU) foam, or a two component glue. The invention is particularly concerned with improvements in the pieces forming the coupling between the container and the dispensing gun or of the container with a handheld applicator.

BACKGROUND OF THE INVENTION

Containers under pressure, containing compounds such as pastes, foams or glues, find increasing use in the building industry as well as in do-it-yourself (DIY) activities. These containers are usually disposable pressure containers, closed off by a relatively simple valve but which needs to withstand the significant pressures which may occur inside the container. Generally two types of applicators are used in current practice. Occasional and DIY users typically prefer a simple handheld applicator, usually also disposable, which is typically screwed onto the stem of the valve of the container and usually comprises a hose or tube for guiding the flow of the compound to its intended location, and a tilting adaptor or lever. Such handheld applicators are characterised in that they do not themselves contain a valve for stopping or controlling the flow of compound, but act on the valve provided on the container for those purposes. Consequently, any compound having passed the container valve and entered the handheld applicator is exposed to the atmosphere and, if susceptible, may react further and convert into its ultimate and usually rigid consistency. For these reasons, these adaptors are simple in design and production, cheap, but most often only useable once, and thus disposable. Typically an action on the tilting adaptor or lever provided as part of the handheld applicator results in a tilting or pushing down of the stem of the container valve, such as in its surrounding rubber grommet in case of a conventional valve, relative to the cup of the valve, such that one or more openings in the valve stem are set free into the container contents, thereby opening the container valve. The assembly is such that the user may hold the container while pushing the handheld applicator, which provides a rough means for controlling and dosing the compound flow. U.S. Pat. No. 4,165,825 discloses suitable valves for such handheld applications. The compound dosing with such handheld systems is however rather inaccurate and such a system is therefore more suitable for filling large crevices or cavities, such as those wider than 2 cm.

The more intensive users, such as professionals or more experienced DIY users, typically prefer a more sophisticated dispensing device, such as a foam-dispensing gun, for applying the compound. With such dispensing devices, the user holds and manipulates the device or foam-dispensing gun, with the compound container being attached to the gun. Such guns are characterised in that they comprise their own valve, preferably a needle valve for higher accuracy and better closure, for stopping or controlling the flow of compound, and this valve is usually located at the tip of the gun barrel and much more sophisticated than the container valve. It typically allows for a much better control of the compound flow as compared to the container valve. Because the valve is located at the tip of the barrel, there remains after use little to no volume of compound which has been exposed to the atmosphere and may react and become rigid. The compound inside the dispensing gun remains under pressure and sealed from the atmosphere, except for the short time required for exchanging a container on the dispensing gun. This time is usually short, and the dispensing gun is typically used immediately after the exchange, such that the compound inside the dispensing gun is refreshed and after use this new compound remains under pressure and fresh in its fluid state. These dispensing guns are usually more complex and expensive and are typically reused several times after replacing the previous empty container with a fresh and full one. The use of these dispensing guns is more comfortable for the user, and allows a higher accuracy and dosing in the application of the compound than the handheld system. Dispensing guns are therefore also preferred for filling up smaller crevices, such as those smaller than 2 cm wide. The higher dosing accuracy allows working with less excess compound, which usually needs to be removed later and ends up as waste. This reduces the amount of aftercare work required and brings a higher efficiency in material use. Both these advantages are of high interest to the professional or intensive user.

Containers intended for the intensive user are for this purpose conveniently provided with a first coupling piece, usually made from a plastic material, which makes the container suitable for attachment to the dispensing gun or dispensing device, and which matches with a connection element integrated in the dispensing gun, or with a second coupling piece which is attached to the dispensing gun, also called a gun adaptor, usually made of metal, such as aluminium or bronze, for making the coupling with the dispensing device or dispensing gun. A suitable foam dispensing gun is for instance disclosed in U.S. Pat. No. 5,271,537, whereby the device comprises a screw connection into which a container may be screwed which has a suitable screw connection, usually by means of a suitable coupling piece on the container.

The first coupling piece of such a screw connection typically surrounds the valve which closes off the container. The screw coupling is usually provided such that when the screw connection is being effected, usually by manually tightening the screw until the stop position is reached, at the same time the valve of the container is brought into the open position and flow of the compound in the container is made possible from the container into the dispensing gun, where it may be stopped and/or controlled by the valve in the dispensing gun. For this purpose, a central internal extension is usually provided on the dispensing gun, or as part of the second coupling piece or gun adaptor, which upon effecting the coupling engages with the stem of the container valve and pushes the valve down in the open position, at the same time providing a seal around the stem of the container valve such that the compound is only allowed to flow via the intended channel through the dispensing gun and avoiding any escape of compound into undesirable locations, where it would foul up the coupling pieces or the dispensing gun. The screw coupling typically requires a plurality of full windings in multiple manual handling steps in order to effectuate the coupling.

It should be noted that the first coupling piece needs to be strongly attached to the container, because the connection needs to withstand the force required for opening the container valve, as well as the force exerted by the pressurized content of the container on the dispensing gun when the valve is opened. It also needs to withstand the torque force when the screw connection is being effected.

As it is commercially offered with its content under pressure, the container or canister intended for use with the dispensing gun is thus typically different from the container intended for handheld use, i.e. with a handheld applicator. The container for professional use is thus usually provided with a first coupling piece which is so strongly attached to the container that its removal, which would be required to allow attaching the handheld applicator for handheld use to the stem of the container valve, would require a prohibitively strong force for the typical occasional or DIY user. It would also lead to unsafe situations, e.g. creating a risk for unintentionally ripping off the valve. Consequently the supply chain has been carrying two types of containers having different designs, one designed for use with the dispensing gun, and the other for use with the handheld applicator.

The containers itself are typically made of metal and are usually cylindrical in shape. The bottom is usually formed by a plate flanged to the cylinder and typically is concave for better withstanding the internal pressure while maintaining the ability for the container to stand upright on a flat surface. The top is usually provided with a container head, also flanged to the cylinder, and which is typically convex for the same reason of higher pressure resistance. A filling opening is usually provided centrally in the cylinder head. When preparing the container for the market, the empty container is typically filled with the compound through this central filling opening in the head, which subsequently may be closed off by flanging the container valve into the filling opening. Many compounds may be filled into the container under atmospheric pressure, and a higher pressure may subsequently be built up or introduced into the container, usually after it is closed off as described. An example wherein pressure builds up after closing the container are the compounds for polyurethane foam, in particular the one-component-foam (OCF), in which, after filling the container, an exothermic chemical reaction between the compounds may be initiated, such as by shaking the container, and the reaction produces heat and builds up pressure by the chemical production and/or the vaporisation of propellants. Propellants for building up the pressure may also be introduced at the moment of filling the container, such as a cold liquid which then is allowed to vaporise after closing the container.

We have found that the valve cup, i.e. the metal part of the container valve which is flanged to the container head and supports the rubber grommet through which sticks the typically plastic stem of the valve, may be pushed outward when the pressure builds inside the container, especially when the exothermic reaction temporarily also raises the temperature. This may have as an effect that the valve, in particular the valve stem, moves away from its initial position. We have also found that the distance that the valve stem may be moved may vary from container to container, and that this distance is difficult to predict as it depends a.o. on the internal pressure in the canister. This brings as a result that the valve stem position may be different from the expected position and not anymore optimal for when the coupling has been effectuated. This repositioning of the valve over an unpredictable distance may thus affect the opening of the valve when the coupling between the container and the dispensing gun is made, such that, upon closing the coupling, the valve may not always reach a desirable degree of opening, or may not open at all, or reversely the valve may open too soon and cause accidental spillage of compound. The screw coupling becomes more vulnerable to this problem the smaller the rotational movement is which is chosen for fully connecting the two coupling pieces.

The containers of the present invention may comprise, under pressure, compounds which are still highly reactive and react out after the compound has been applied into its final location, such as in a crevice or on to a substrate. Contact of the container content with skin, or even more importantly with eyes, is therefore to be avoided. For safety reasons, the containers ready for market are therefore always provided with a protecting cap, which is supposed to shield the container valve and in particular the valve stem from being damaged, ripped off or being touched and moved relative to the valve cup, and thus for reasons of safety and for protecting against accidental spillage. The containers for handheld use are typically supplied without a coupling piece, i.e. with the valve fully accessible. Therefore such containers are conventionally supplied with a separate shielding cap which is usually clicked onto the flange around the container head. The containers for professional use are provided with the first coupling piece, typically snapped onto the flange around the valve cup. Access to the valve stem through this first coupling piece is then typically closed off with a separate cap, which may for instance snap onto the upper rim of the coupling piece, which may be suitably adapted for snapping on the cap, such as by providing a small collar.

Separate caps have been designed, and the head of the coupling piece on the container may be made suitable to accept these caps as seals for the valve compartment. This design requires the separate production of a cap and the need for an extra step in the assembly of the container, i.e. to put the cap onto the head of the coupling piece.

This shielding cap thus represents an extra element which needs to be produced separately and needs to be assembled with the coupling piece before or after attaching the coupling piece on the container. The shielding cap for the container intended for handheld use also represents a separate assembly element. These caps therefore create an extra burden in the supply chain of the containers, in the sense that there is a need to carry two types of containers and for both types an extra assembly element has to be provided and assembled.

There has therefore been a need for a two-in-one design, i.e. a container which would be suitable for use with a dispensing gun as well as with a handheld applicator, and/or a handheld applicator which would be suitable for use with the container assembly intended for use with the dispensing gun.

We have also found that there exist a variety of dispenser devices or gun applicators for the screw coupling, but all do not necessarily expect the stem of the valve of the container to be in exactly the same position relative to the screw threaded section of the first coupling piece. In addition, as explained above, the valve cup may become bulged or pressed outward by the internal pressure, and temperature, building up in the container after filling and closing, possibly after homogenising its content for starting the chemical reaction. This may further lead to a mismatch between the container valve stem location and the dispenser device or gun applicator, and may thus lead to suboptimal performance, such as unintentional leakage of compound when the container is coupled to the gun applicator.

WO 2007/112758 discloses a handheld applicator which may be fastened onto the valve stem of a container intended for use with a dispensing gun. The handheld applicator may then be "clicked" directly on the valve-stem. The difficulty with this design is that fastening of the handheld applicator onto or off the valve stem needs to be performed very carefully, as any tilting of the valve would cause premature and unintentional spillage of compound, and any damage to the valve may create a safety hazard.

US 2007/0181610 A1 discloses a handheld applicator which is suitable for being snapped onto the flange around the container valve. The drawback with this proposal is that the first coupling piece, with which a container for use with a dispensing gun is usually sold, needs to be removed from the container before the flange is available for snapping on the handheld applicator. The difficulties and safety issues of such a removal have been discussed above. Such manipulation is strongly disadvised because of the safety risks involved, especially the risk for getting compound into the eyes. A further problem may occur when the container valve has moved under the internal pressure of the container.

Other systems have been developed, where a handheld applicator may be screwed into a threaded internal section of the coupling piece intended for the dispenser device. The difficulty with such systems is that the valve opens while the applicator is being screwed into place, and the degree of screwing defines the opening of the valve and thus the flow of the compound. Especially occasional users prefer to use their two hands for screwing on the applicator, and it is very difficult to achieve, at the same time while screwing on the applicator, also a good and accurate application of the compound. Another coupling piece with a threaded internal section is for instance described in FIGS. 13 and 14 of WO 2009/004097. In the assembly with the container disclosed in WO 2009/004097, the valve cup is still given the freedom to deform, bulge or be pushed outward under the pressure which builds inside the container after filling and closure. The risk remains that the valve cup deforms, and that the stem of the container valve moves away from its initial position, such that any coupling with a gun dispenser or a handheld applicator is suboptimal.

DE 3518627 A1 discloses a two-part coupling piece wherein the first external part is provided with circular grooves, and the second internal part is provided with ring-shaped protrusions. The internal part is inserted after fitting the first external part over the valve flange of a container, and reinforces the connection of the coupling piece with the container. Also in the assembly with the container disclosed in DE 3518627 A1, the valve cup retains the freedom to deform, bulge or be pushed outward under the pressure which builds inside the container after filling and closure. The risk remains that the valve cup deforms, and that the stem of the container valve moves away from its initial position, such that any coupling with a gun dispenser, or with a handheld applicator provided with similar ring-shaped protrusions, would be become problematic.

Improved coupling pieces have also been designed for attachment to the container, whereby an integrated cap is provided for manually being broken off from the coupling piece, and upon removal providing access to the valve of the container. In some versions these integrated caps are made such that the cap, after having been broken off, may be replaced again onto the coupling piece, such that the valve compartment may be reclosed, such that a partially used container may be transported and stored safely and conveniently before being used again. Improved coupling pieces having these features have been designed such that they may be produced as one single product in a single production step, such as by a single injection moulding step. This design of a coupling piece with integrated cap for single step production is however incompatible with the provision of the internal rim, also called the "support ring" which is desired for offering additional and exterior support to the valve cup, such that the valve stem is retained in place when the pressure inside the container builds up, such as part of the Click-and-Fix system disclosed in WO 98/43894.

There therefore remains a need for a two-in-one design, i.e. a coupling piece for coupling a container with a dispensing device or dispensing gun, which at the same time also provides the possibility without having to first remove the coupling piece for coupling the container with a handheld applicator, i.e. for handheld use, and which applicator only may open the container valve after the handheld applicator has been coupled to the coupling piece and the container, and which assures the dimensional stability of the valve cup, such that upon coupling with the dispensing gun or with the handheld applicator, the risk for unintentional leakage of compound from the container is reduced and preferably avoided. There remains the further need for having this improved coupling piece provided with an integrated cap and also with internal legs providing exterior support for the valve cup, and which may also be produced as a single product in a single production step.

The present invention aims to obviate or at least mitigate the above described problem and/or to provide improvements generally.

SUMMARY OF THE INVENTION

According to the invention, there is provided an improved first coupling piece and a matching handheld applicator, an assembly of the first coupling piece and a container, a process for the production of the first coupling piece, of the handheld applicator, of the assembly, and the use of any of these as defined in any of the accompanying claims.

The invention therefore provides a first coupling piece for attachment to a container which coupling piece is provided with an externally threaded section for screwing into a dispensing gun, or into a second coupling piece provided for attachment to the dispensing gun, the dispensing gun being suitable for applying a component present in the container and the two coupling pieces or the first coupling piece and the dispensing gun together being suitable for providing a screw coupling between the container and the dispensing gun, the container comprising a valve for closing off the container, the valve comprising a valve stem surrounded by a valve cup which is flanged to the container head, whereby the valve of the container is provided for being opened during effectuation of the coupling with the dispensing gun, characterised in that the first coupling piece is further provided with first means suitable for coupling with a handheld applicator for applying the component present in the container, which handheld applicator is provided with second complementary cooperating means for providing the coupling between the first coupling piece and the handheld applicator, and being suitable, in an assembly of the container and the first coupling piece together with the handheld applicator, for enabling the opening of the valve of the container by an action on the handheld applicator, the coupling piece further comprising an internal support rim or one or more internal support legs which are providing an internal rim or sections of an internal rim for engaging with the outer surface of the valve cup of the container valve for when the first coupling piece is attached to the container.

The coupling piece according to the invention provides the advantage that the coupling piece is dual purpose, i.e. it may be used in combination with an application device or a dispensing gun, optionally by means of a second coupling piece, such as for intensive use by e.g. a professional or intensive DIY user or for smaller crevices, cavities or cracks, but it is at the same time also suitable for use of the container to which it is attached in handheld mode, with a suitable handheld applicator, such as for less intensive use or for larger crevices, cavities or cracks. This brings the significant advantage that the supply chain only needs to carry one type of products, i.e. the assembly of a full container with the coupling piece according to this invention, in order to satisfy the needs of the two uses or type of users. It also avoids the difficulties and safety issues associated with removing the coupling piece from the container before one of the known handheld applicators can be snapped onto the flange around the valve cup of the container. The applicants have found, as explained above, that the valve cup may become bulged by the internal pressure, and temperature, building up in the container after filling and closing, possibly after homogenising its content for starting the chemical reaction. This may thus lead to a mismatch between the container valve stem location and the dispenser device or gun applicator, and may thus lead to suboptimal performance, such as unintentional leakage of compound when the container is coupled to the gun applicator. The applicants have found that this problem may also present itself when a handheld applicator is coupled with the coupling piece already attached to a container. This coupling operation may thus also lead to unintentional leakage of compound when the handheld applicator is coupled to the assembly, which may present several problems to the user, including a safety risk.

The applicants have found that these problems with the screw coupling may also be alleviated by the coupling piece according to the present invention. The first coupling piece according to the present invention therefore comprises the internal support rim or the one or more internal support legs which are providing an internal rim or sections of an internal rim for engaging with the outer surface of the valve cup of the container valve for when the first coupling piece is attached to the container. This provides exterior support for the valve cup such that the valve stem is maintained in its original position even when the pressure increases inside the container. This thus avoids or mitigates the problem of valve stem repositioning which is explained above. Also the risk for premature leakage of compound during the effectuation of the coupling with the dispensing gun or with the handheld applicator is reduced, as well as the risk for other flaws in the operation of the assembly.

The invention further provides for an assembly of a container with the first coupling piece according to the invention. The benefits described in this document for the coupling piece of the present invention also apply to this assembly.

The invention further provides for a handheld applicator which has the required features to match the features of the first coupling piece of the present invention necessary for making the coupling between the two, such that it may be coupled with the first coupling piece, or with the assembly thereof with a container, and be used for handheld application of the compound in the container.

For that purpose, the invention also provides a handheld applicator for applying a component present in a container characterised in that the handheld applicator is provided with second means for coupling with the first coupling piece according to the present invention, the second means being complementary cooperating with the first means provided on the first coupling piece and together being suitable for providing a coupling between the handheld applicator and the first coupling piece, and also being suitable, in an assembly of the container and the first coupling piece together with the handheld applicator, for enabling the opening of the valve of the container by an action on the handheld applicator.

The advantage of this handheld applicator is that, together with the matching coupling piece, it provides for the possibility to use the container provided with the coupling piece suitable for professional use with a dispensing gun also in handheld mode. This allows the supply chain to offer only one product for the two uses or type of users.

The invention further provides for the use of the first coupling piece, or the assembly of the container with the first coupling piece, according to the present invention, with a handheld applicator, i.e. an applicator suitable for handheld use.

In another embodiment, the invention provides for a process for producing the first coupling piece according to the present invention, comprising a step of injection moulding. The first coupling piece according to the invention may be produced as one single product in one single production step, with a mould suitably designed for that purpose, and which may comprise a plurality of mould elements which are able cooperate in order to form the first coupling piece.

In yet another embodiment, the invention also provides for a process for producing the handheld applicator according to the present invention comprising a step of injection moulding. The handheld applicator according to the invention may be produced as one single product in one single production step, with a mould suitably designed for that purpose, and which may comprise a plurality of mould elements which are able cooperate in order to form the handheld applicator.

DETAILED DESCRIPTION

Figure 1:
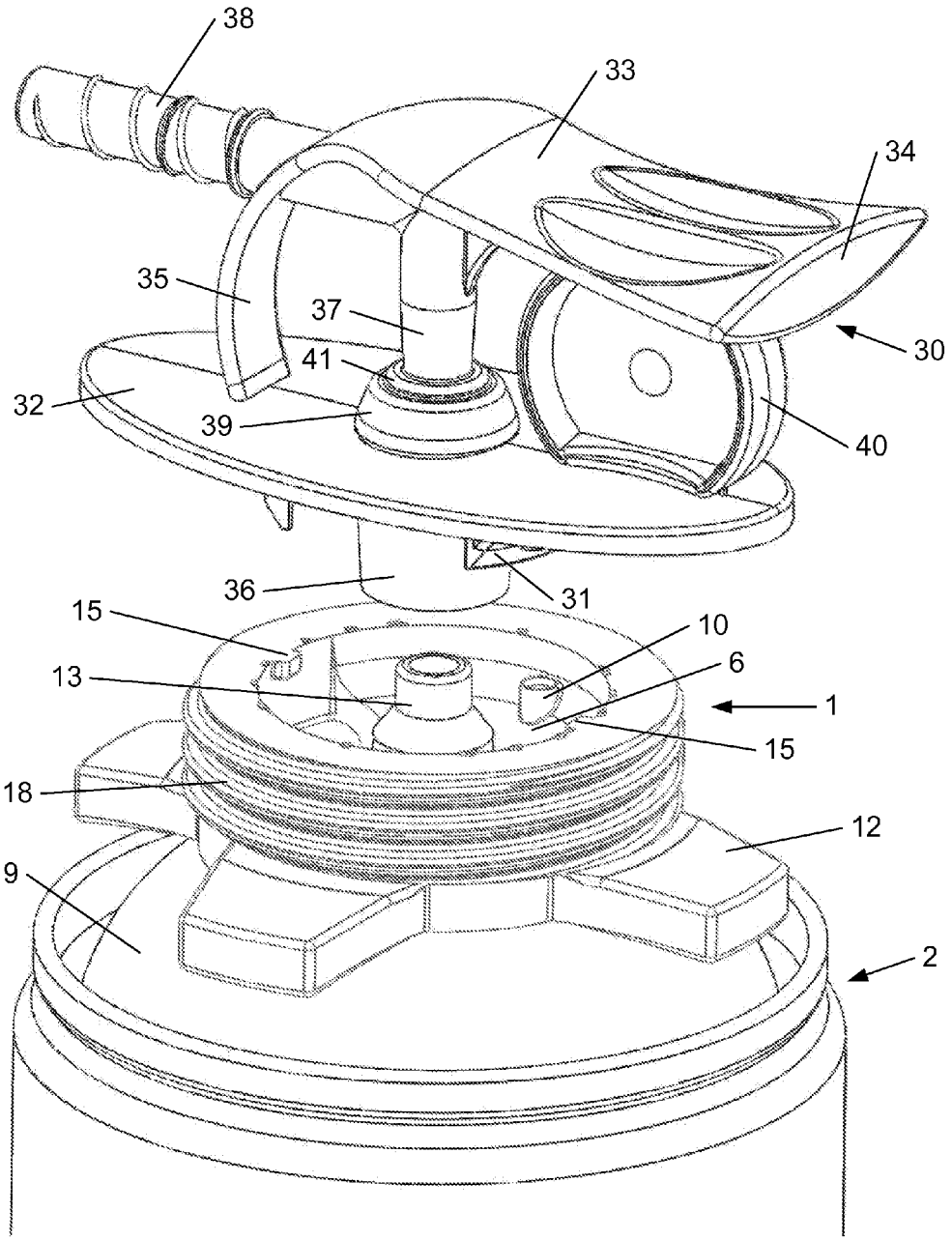
FIG. 1 shows a top perspective view of an assembly of a first coupling piece according to the present invention, snapped onto the valve flange of a container and with the integrated cap broken off to allow access to the container valve. In the same figure, above the assembly, is shown a handheld applicator according to the present invention, in an exploded view as it would have been coupled to the first coupling piece.

The containers for compounds under pressure are typically designed as cylinders. The bottom is usually closed off by flanging a concave bottom plate onto the cylinder. The top of the cylinder is typically closed off by flanging on a convex head plate, with therein a central opening through which the container may be filled with its content. As explained before, after filling, this opening may be closed off with a valve through which the container content may be released using the pressure which is built up inside the container. At room temperature, the pressure inside a filled and ready-to-use container is typically about 5 bar gauge. The containers are typically able to remain intact up to a pressure of 18 bar gauge, and are designed to not burst open with a pressure below 21.6 bar gauge. The valve is typically designed to resist a pressure up to at least 22 bar gauge. Other containers exist, which are only able to remain intact up to a pressure of 12 or 15 bar gauge. The container valve usually comprises a valve cup, i.e. a round metal cup which may be flanged at its perimeter into the central filling opening of the container, optionally in addition using a rubber seal. In the conventional valve design, the valve cup is supporting a central rubber grommet through which a usually plastic valve stem sticks. The stem is rigid and typically has a central duct which turns, just before the stem ends at its lower end in a blind flange, sideways into one or more, typically four, side openings. In a state at rest, the rubber grommet pulls the blind flange up against the bottom of the grommet and seals off the openings. The valve may be opened by tilting the stem or by pushing the stem down relative to the grommet or cup, whereby typically the grommet deforms elastically and whereby at least one of the side openings in the valve stem becomes available for the container content.

Because the rubber of the grommet of the conventional valve, particularly when carbon black has been used as a filler in the rubber, allows diffusion of water, which then may react with certain compounds in the container to form a sticky solid, the conventional valve has the disadvantage that the valve stem may become blocked over time, or when the container has been for some time in a horizontal position. This may already occur when the container has been lying on its side for a period of only 3 to 6 weeks. A further disadvantage is that the rubber of the grommet also allows diffusion of propellant gasses out of the container, such that the container may lose most or all of its pressure after a while. For these reasons, other types of valves have been developed, which may not comprise the rubber grommet as described for the conventional valve. Such container valves may also be known as "feststof" valves, and suitable variants thereof are for instance described in WO 2009/004097, U.S. Pat. No. 5,014,887, WO 03/062092, or U.S. Pat. Nos. 5,215,225, 5,549,226 and 6,058,960. These valves have no rubber grommet, or only have a grommet on the outside part of the valve which is not in contact with the contents of the container, but do have a valve cup and a stem. The valve cup may still be susceptible to deformation under internal pressure inside the container. These valves are typically provided with a sealing section at the outside of the valve stem, suitable for forming a seal when brought in contact with a gun adaptor, a dispensing gun, or a handheld applicator.

These "feststof" valves may thus be characterised in that the materials of the valve parts coming in contact with the container contents are substantially impermeable for water and/or propellant gasses. The valves may for instance be provided with one or even more than one metal spring, being a spiral spring or a leaf spring or a combination thereof. The spring or springs may be provided and tailored such that the valve may be easier to open than a conventional valve, and thus offer further improved ergonomics to the user, as well as improved aiming and dosing capabilities. The springs may also assure a faster closing of the valve as compared to the conventional valve. A valve with an internal spiral spring is for instance disclosed in U.S. Pat. No. 5,014,887. Valves with external spiral springs may be found as part of the family of valves MIKAVent PU-RF, available from Mikropakk. Particularly suitable feststof valves are disclosed in EP 2028131 A2. The applicants prefer the valve which is shown on FIG. 6 of EP 2028131 A2, which has an external spiral spring, and is particularly simple in design and easy to assembly. Valves with a blade spring may be found in U.S. Pat. No. 6,058,960, WO 03/062092 and WO 2009/004097.

The first coupling piece according to the present invention is rotatably connectable to a dispensing device or dispensing gun, optionally by means of a second coupling piece as part of an assembly as disclosed in U.S. Pat. No. 4,165,825. This second coupling piece or gun adaptor, or the dispensing device or dispensing gun itself, is provided for that purpose with typically a female threaded section for accepting the typically male threaded section of the first coupling piece according to the present invention.

The screw threads preferably engage with each other over a plurality of windings, such that the coupling is by itself already strong and represents a low risk for loosening of the coupling in case the container contains a pressurised compound.

The first coupling piece according to the present invention is provided for attachment to the container, preferably comprising means for attaching the coupling piece to the collar or flange where the valve cup connects with the container head. Optionally, the coupling piece may attach to the flange of the container head with the cylinder. In another embodiment, the coupling piece may comprise means for attaching the coupling piece to both these flanges.

If the coupling piece for attachment to the container is only attached to the flange of the valve cup with the container head, we have found that it may be very difficult, sometimes impossible, to unscrew the coupling. It may further occur that, upon screwing or unscrewing the coupling, when some force is exerted on the coupling piece, the coupling piece may move with respect to the container, sliding around on the valve cup. This may for example occur when the screw thread is fastened rather thoroughly, or when some of the compound from the container has contaminated the screw thread and may act as an adhesive. It may result in a coupling which may not be uncoupled again, such that the second coupling piece or even the dispensing device or gun applicator becomes useless and has to be discarded.

By attaching the coupling piece to the larger flange connecting the container head to the cylinder of the container, and preferably to the two flanges, the contact surface between the coupling piece and the container may be significantly increased. The increased contact surface results in an increased frictional resistance such that a higher momentum needs to be overcome in order to permit the coupling piece to move with respect to the container. This offers an improved attachment of the coupling piece to the container, and helps to prevent that the coupling piece is moveable with respect to the container. It also results in a lower rejection rate of used second coupling pieces.

In an embodiment of the first coupling piece according to the present invention, the two means suitable for providing a coupling between the coupling piece and the handheld applicator comprise a guide and at least one protrusion for cooperating with the guide, preferably a pin-and-groove connection, which protrusion is moveable within the guide between a first position and a second position, in not more than one full 360 degree turn, the first position corresponding to an uncoupled state of the coupling between the coupling piece and the hand held applicator and a closed position of the valve of the container, and the second position corresponding to a coupled state of the coupling between the coupling piece and the handheld applicator and a position of the container valve which is closed and ready to be opened by the action on the handheld applicator. We prefer that the coupling with the handheld applicator may be made with not more than a half or 180 degree turn, and more preferably with not more than a quarter or 90 degree turn. This embodiment may be called a bayonet-type coupling between the coupling piece and the handheld applicator, in particular when there are two protrusions and two cooperating guides, typically located at opposite sides relative to the central axis of symmetry of the coupling piece.

In a preferred embodiment of the coupling piece according to the present invention, the first means suitable for providing a coupling between the coupling piece and the handheld applicator comprises two protrusions internal to the coupling piece and located diametrically opposite to each other with respect to the position of the container valve in the assembly of the container, the first coupling piece and the handheld applicator, preferably the first means comprising two pins for cooperating with two grooves in the handheld applicator. We have found that these features make a very simple yet convenient bayonet-type coupling.

With such an extra feature, the coupling with the handheld applicator may be effectuated in one continuous and short movement which is time saving and very convenient for the user. At the same time it also reduces the risk for unintentional release of compound during the making of the connection with the handheld applicator.

The protrusion and guiding for the coupling with the handheld applicator according to the invention preferably comprise at least one pin-and-groove connection. With such a pin-and-groove connection, the coupling may be effectuated in one short movement. Thereby a large tolerance can be provided, so as to facilitate the insertion of the pin in the groove. We prefer the groove or grooves to have a wider opening where the pin has to enter, and to taper narrower towards their end or stop. This makes it easier to achieve a correct position of the pin or pins for entering their respective groove, but at the same time secures that the coupled position of the two pieces is accurately as desired.

The pin-and-groove connection preferably comprises two diametrically opposed pins, and two diametrically opposed grooves, which grooves are provided to co-operate with the pins. This reduces the risk that the handheld applicator, when being coupled to the first coupling piece, would unintentionally tilt or push the valve stem down with respect to the grommet and cause an unintentional opening of the container valve.

In an embodiment, we prefer that the first means suitable for providing a coupling between the coupling piece and the handheld applicator comprise two protrusions internal to the coupling piece and located diametrically opposite to each other with respect to the position of the container valve in the assembly of the container, the first coupling piece and the handheld applicator, preferably the first means comprising two pins for cooperating with two grooves in the handheld applicator.

In another embodiment of the present invention, the first coupling piece is provided with an integrated cap provided for being broken off manually and for requiring its removal in order to allow access to the container valve and an effectuation of any one of the two couplings. The cap is required for safety reasons. We prefer to have an integrated cap, which is produced as an integrated element of the first coupling piece during its production step. This avoids the need for providing the cap as an extra and separate element, which requires an extra assembly step in the production line which prepares the container for market, and thus simplifies the assembly process.

In another embodiment, the integrated cap is preferably provided with open segments. This allows for pieces of the mould to stick through the cap during the production process and which pieces may help shaping the internals of the coupling piece. In a further preferment, the area covered by a first projection 6', of the open segments in the cap and made along the axis of rotation AA' of the screw coupling and onto a plane B perpendicular to this axis of rotation, comprises the area covered by a second projection 8', made along the same axis and onto the same plane, of the internal surfaces of the internal support legs which face the axis of rotation. This brings the advantage that the internal support legs, for engaging with the valve cup of the container and securing the position of the valve cup, grommet and stem, may be shaped at the same time as the integrated cap is shaped. This way the coupling piece with its integrated cap and interior support legs may be produced as one single product in one single production step, bringing also the assembly advantages associated therewith.

We have found that under these conditions the first coupling piece from the screw coupling, i.e. the coupling piece for attachment to the container, enjoys all of the following advantages, i.e. that (a) it is provided with an integrated cap for shielding the valve of the container it is intended to be attached to, (b) it provides exterior support for the valve cup of the container valve such that the valve stem is retained in position even when the pressure inside the container increases subsequent to attachment of the coupling piece to the container, and (c) the coupling piece may be produced as a single product in a single production step, such as by injection moulding.

In an embodiment of the present invention, preferably the larger of the two projections described above is extending at most 2 mm, more preferably at most 1 mm beyond the perimeter of the smaller projection. More preferably the two projections overlap as fully and exactly as possible, given a small tolerance of at most 0.6 mm, preferably at most 0.4 mm, more preferably at most 0.2 mm and even more preferably at most 0.1 mm. This brings the combined advantage that the shielding effect of the cap for the container valve may be maximized, while at the same time the area of engagement of the internal rim of the first coupling piece, or the sections of such internal rim, with the valve cup may also be maximized, while the capability to produce the coupling piece as one single product in one production step is maintained.

In an embodiment of the present invention, the cap comprises an outer ring and a centre piece running along one diameter. The outer ring of the cap provides room for a plurality of low strength connections between the cap and the coupling piece and which may be formed in the single production step. This cap design also allows to leave two open segments in the cap within the outer ring and on both sides of the centre piece running across the circular cap along one diameter, through which parts of the mould, preferably one single part of the mould, i.e. the part or parts intended for forming the internal surfaces of one or preferably two internal support legs, may move back out of its or their position during the moulding process, and hence may readily release the produced coupling piece after the moulding step. The internal legs may thus preferably provide two sections of an internal rim for engaging with the valve plate. The applicants have found that this embodiment is one possible way in which the sections of the internal rim may together provide at least 30%, preferably at least 35%, more preferably at least 40%, even more preferably at least 45% and most preferably 50% of a full circle internal rim such as the one which was provided in the Click-and-Fix design as disclosed in WO 98/43894. The applicants have found that two sections together providing such portion of a full circle internal rim provide sufficient exterior support to the valve cup in order to secure the valve stem in its desired position.

In one embodiment of the present invention, the coupling piece is further provided with at least one first element and the integrated cap is provided with at least one second element for cooperation with the first element in order to removably reattach and/or reclose the cap onto the first coupling piece, i.e. to attach the cap onto the first coupling piece after it has been broken off from the coupling piece. This converts the cap into a reclosable cap. This feature brings the advantage that the valve compartment may be reclosed with the cap in between successive uses of the same container. In a preferred embodiment, the coupling piece is provided with at least two such first elements and the cap is provided with at least two such second elements, bringing the advantage of at least two fixing points for the cap onto the coupling piece, providing a stronger attachment of the cap and hence a lower risk for unintentionally loosing the cap. In a preferred embodiment, the cap is provided with two male elements, such as cylindrical click-in legs sticking out downwards, and the coupling piece is provided with two female elements, such as corresponding sleeves, and the legs and sleeves are provided to cooperate such that the legs may be removably inserted into the sleeves and engage sufficiently to keep the cap in place. We prefer to have the male elements to stick out downward from underneath the center piece of the cap, and the sleeves being provided as part of the internal legs of the first coupling piece which are providing the sections of the internal rim for engaging with the valve cup. This brings the advantage that these elements may be formed at the same time as the first coupling piece including its integrated cap, and that the entire coupling piece may be made in one single production step, such as an injection moulding step. After the cap has been broken off from the coupling piece, the elements may be provided such that they match and are able to cooperate when the cap is turned, such as around the axis of symmetry of the coupling piece, over an angle, such as about 90°, from its original position.

Preferably the cap has a lip or handle for facilitating the handling of the cap, such as the manual breaking off of the cap from its integrated position on the coupling piece and/or the removal of the cap from its reclosed position.

In another embodiment of the present invention, the coupling piece is further provided with an external flat surface, preferably the external flat surface being provided on the integrated cap when the cap is present. This brings the advantage that the coupling piece may be picked up, preferably from above, by means of a vacuum applied through a suction cup engaged on the external flat surface provided on the coupling piece, preferably on the integrated cap, and the coupling piece may be released by breaking the vacuum after the coupling piece having been brought into a position on the container which position is suitable for the coupling piece being snapped onto the container. This external flat and smooth surface enables a very convenient method for bringing the coupling piece in contact with a container before snapping the piece on the container and producing the assembly of the two parts.

In yet another embodiment, the first coupling piece is itself provided with at least one handle, optionally two handles or wings, and preferably as much as 3 or even 4 handles or wings. These wings may be of service when the coupling piece is being snapped onto the container. They are of further service for keeping the coupling piece into position when it is being screwed into a second coupling piece or into a dispensing gun, or when this coupling is being unscrewed. They may also be of similar service when the handheld applicator is being coupled onto the coupling piece. They may further provided handles for unsnapping the coupling piece from the container, in case this attachment may need to be undone, an action which is however disadvised because of the safety issues discussed before.

The coupling piece according to the present invention is preferably further provided with a plurality of stabilising pins suitable for stabilising the position of the coupling piece on the container and/or the container head before it may be snapped onto the one or two flanges at the container head. This better secures the coupling piece in the correct position for snapping it onto the flange or flanges of the container and/or valve cup as explained above.

In the embodiment with the stabilizing pins, the stabilizing pins are preferably provided as weak pins for engaging with the collar or flange where the valve cup connects with the container head, optionally with the flange of the container head with the cylinder, and yet more preferably with both these flanges, and/or for gripping over at least one and preferably both of the flanges. Such weak pins may then partly or entirely disintegrate or break off during the snapping of the coupling piece onto the container, and end up creating extra contact surface with the container which reinforces the attachment to the container compared to only having the collars which are conventionally provided for securing the attachment.

In another embodiment of the handheld applicator according to the present invention, the second means for coupling with the first coupling piece comprises at least one guide, and preferably two guides, for accepting each a protrusion of the first coupling piece whereby the protrusion is moveable within the guide between a first position and a second position, in not more than one full 360 degree turn, preferably in not more than a 180 degree turn, more preferably in not more than a 90 degree turn, the first position corresponding to an uncoupled state of the coupling between the coupling piece and the handheld applicator and, in an assembly of the container and the first coupling piece, a closed position of the container valve, and the second position corresponding to a coupled state of the coupling between the coupling piece and the handheld applicator and, in an assembly of the container and the first coupling piece together with the handheld applicator, a position of the container valve which is closed and ready to be opened by the action on the handheld applicator, preferably the second means comprising two grooves external to the handheld applicator and located diametrically opposite to each other for accepting two pins provided internally on the first coupling piece.

In another embodiment, the handheld applicator of the present invention comprises a fixed part for coupling with the first coupling piece and a moveable part for accepting the action on the handheld applicator, preferably by a handle, and for by its movement opening the container valve, whereby the fixed part and the moveable part are preferably connected to each other by a joint, preferably a hinge joint, preferably the fixed part, the joint and the moveable part being provided as integrated parts of the handheld applicator. The applicants have found that by properly designing the details of the handheld applicator, it is possible to produce a very convenient handheld applicator having these features by using only one single construction material, such as a polymer. Parts which preferably remain rigid, such as the fixed part or the moveable part, may be designed with reinforcing ribs or elements to provide extra rigidity. Other parts, such as the joint or a membrane, may be shaped and designed to allow them to be flexible yet not break during normal use. Other parts may be rigid but connected only with small and weak connections to the rest of the handheld applicator, such that they may be manually broken away.

In another embodiment of the present invention, the handheld applicator comprises a hollow cylinder as receiving device for engagement with the container valve, a conveying tube for the container content to be discharged which is moveably arranged with the receiving device, preferably this conveying tube being provided with a connection to accommodate a trunk or hose for enabling the container content to be discharged in a well-aimed manner, whereby the handheld applicator further comprises a handle to actuate the conveying tube for engaging with the stem of the container valve, whereby the grommet of the container valve, if present, is compressed in the direction of the action on the stem and expands, also called ballooning, perpendicular to this direction and is further pressed against the hollow cylinder of the handheld applicator thereby providing or tightening the seal which may already exist between the valve and the receiving device of the handheld applicator.

In this embodiment of the handheld applicator according to the present invention, the receiving device is preferably flexibly connected with the conveying tube such that by the action on the handheld applicator the conveying tube is vertically displaced relative to the receiving device, preferably the flexible connection being with a shoulder on the conveying tube and/or the flexible connection being by means of a membrane, most preferably the membrane being integrated into the handheld applicator. The vertical displacement caused by the action on the handheld applicator also causes a vertical displacement of the valve stem. This brings the advantage that the valve grommet, if present, is compressed along its axis of symmetry, which causes the grommet to balloon substantially equally at all sides, which causes a better seal with the receiving device or the hollow cylinder part thereof. In the case without the grommet, the seal is provided between the outer surface of the stem, which is provided with a sealing section, and the receiving device. Also in this case is it preferred to have essentially a vertical movement of the stem, such as not to deform the seal integrity or its function.

In a preferred embodiment of the present invention, the handheld applicator is provided with a safety seal for being removed and for requiring its removal for enabling the action on the handheld applicator to open the container valve, preferably the safety seal being provided as an integral part of the handheld applicator and/or the seal being provided as a rigid part fixing the position of the moveable part relative to the fixed part of the handheld applicator.

In selected embodiments of the present invention, the first coupling piece and/or the handheld applicator is or are made of a plastic material, and this may be provided with fibrous reinforcing material. The first coupling piece and/or handheld applicator is preferably made of nylon 6 or polypropylene (PP). Other suitable materials are high density polyethylene (HDPE), polyamide (PA), polycarbonate (PC) or acrylonitrile butadiene styrene rubber (ABS), or mixtures of any of the named materials. Preferably also the second coupling piece or gun adaptor may be made of a similar or identical construction material, although that may also be made of metal, such as aluminium or bronze.

As stated before, the invention also provides for an assembly of a container with the first coupling piece according to the invention. This assembly enjoys the advantages listed above for the coupling piece. The assembly may further comprise the dispensing device or dispensing gun suitable for applying the component present in the container, optionally also comprising a second coupling piece or gun adaptor. Alternatively the assembly may further comprise a handheld applicator according to the present invention.

In the assembly according to the present invention comprising a container and the first coupling piece, the container may contain a composition suitable for forming a silicone paste, a polyurethane (PU) foam, or a glue.

The container according to the present invention may contain either a one or two component formulation, or a so-called 1.5 component system. In the case of the one-component formulations, the moisture reactive groups of the dispensed prepolymer cure by reaction with atmospheric moisture. This reaction is usually accompanied by cross-linking and an increase in volume. In case of 2-component systems, chemical curing is achieved via reaction of the reactive groups with the second reactive component (mostly amines, water or hydroxyfunctional molecules). With so-called 1.5 component foams a hydroxy or amine component or a mixture thereof is added to the prepolymer before being dispensed in such an amount that full or partly conversion of all moisture reactive groups is achieved. Further moisture curing (if needed) is achieved after dispensing. This 1.5 component system brings the advantage that the curing of the applied foam is significantly faster, such that the foam may be cut or trimmed quicker after the application thereof, which is of convenience for the user, particularly for the professional user. A further advantage of the 1.5 component foam system is that the foam reaches a higher final density, which provides better mechanical properties, such that this foam is particularly suitable for construction purposes, and e.g. may be used for mounting window frames and doors even without needing screws or bolts.

The applicants prefer to achieve a foam which ultimately has an open cell structure, because this brings an advantage in that the foam is less susceptible to shrinkage. This reduces the risk that the foam would break loose from its surface, or that crevices develop, through which the insulation properties of the foam may be impaired. Also the risk for loosing the mechanical properties is thereby reduced. An open cell foam provides better integrity, in particular over the longer term. In addition, when flammable propellants are used, an open cell structure foam will also ultimately achieve better fire proof and flame retardant properties because the propellants are able to migrate out of the foam. For this purpose, the applicants prefer to add a cell opener to the foam formulation. Cell openers are well known in the art, and typically suitable compounds include paraffin or silicon oils, silicone-free polymers based on polyvinyl alkyl ether with a foam-inhibiting effect for example BYK-051, -052 and -053 from BYK-Chemie GmbH, silicon-containing polymers like Tegostab B-8871, Tegostab B-8934, Tegostab 8935, available from Evonik, Niax L-6164, available from GE Silicones, Struksilon 8101, Struksilon 8002, available from Schill & Seilacher. Mechanical cell opening can be achieved by incorporating solids, for example talcums, calcium carbonates, etc. Defoaming additives applied in low concentration levels are also possible cell-openers. The cell opening additives are typically added in quantities of 0.01 to 2, preferably 0.1 to 1 wt % (as such or as combinations thereof), usually based on the prepolymer component. Known foam stabilizers having cell opening activity are: Tegostab B8871, 8934 and 8935 available from Evonik; Struksilon 8101 and 8002 available from Schill and Seilacher. Known cell openers and anti-foaming agents (depending on their concentration) are: Baysilon M100 available from Bayer, Paraffinoil 7160 available from Merck, Niax L6164 available from Momentive, and the Ortegol 501 (polybutadiene) en 505 available from Evonik. Other types of silicone oils and paraffinic oils may be considered as evenly effective.

The process for producing the coupling piece according to the present invention preferably comprises a single injection moulding step, more preferably only one single injection moulding step. The mould may be formed by for instance using at least four matching mould pieces, preferably only four mould pieces, which are able to move relative to each other for closing and opening the mould, preferably the mould pieces move perpendicularly and/or parallel to each other as appropriate. Two of these mould pieces are preferably cooperating with each other, by approaching each other along the direction of the axis of rotation of the coupling, and may together form the internals, including the internal support legs, of the coupling piece and the cap, whereby one mould piece may delimit the upper surface of the cap and, through the open segments in the cap, also delimit the internal surfaces of the support legs which face the axis of rotation. The second and cooperating mould piece may suitably delimit the lower surface of the parts of the cap which are located in between the open segments in the cap, as well as the lower surfaces of the rest of the coupling piece including any peripheral rim and any recess and snap rim which may be provided in the interior side of the peripheral rim. The third and the fourth mould piece may then cooperate together to delimit the side surfaces of the coupling piece, to form the screw thread required for effecting the coupling, any lips which may be provided as part of the cap, any lips which may be provided on the peripheral rim of the coupling piece for handling, or possibly for bolting the coupling, and the at least one low strength connection between the integrated cap and the coupling piece. Further mould pieces may just serve to reduce the amount of material required for making the first coupling piece.

In the process according to the present invention the mould may therefore comprise at least 4 parts which are able to move relative to each other, preferably perpendicularly and/or in parallel to each other, as appropriate, for closing and opening the mould. We prefer to use only 4 parts for the mould.

In a preferred embodiment, the process further comprises the step for assembling the first coupling piece with a container.

In this embodiment, we prefer that the coupling piece is picked up, preferably from above, by means of a vacuum applied through a suction cup engaged on the external flat surface which is preferably provided on the coupling piece, more preferably on the integrated cap, and whereby the coupling piece may be released by breaking the vacuum after the coupling piece having been brought into a position on the container which position is suitable for the coupling piece being snapped onto the container.

The invention further provides for a process for the production of the handheld applicator according to the present invention comprising a step of injection moulding, preferably only one single step of injection moulding. We prefer to have a handheld applicator which may be produced in one single production step. This keeps the complexity of the production process to a minimum, and thereby keeps the cost low for a product which is intended for only one single use.

In the process for the production of the handheld applicator of the current invention, we prefer that the mould comprises at least 2 parts, possibly four parts, which are able to move relative to each other, preferably perpendicularly and/or parallel to each other, for closing and opening the mould, preferably the mould comprising only 2 parts and optionally in addition in combination with one or two cores for shaping at least one opening internal to the handheld applicator, such as the conveying tube and/or the hollow cylinder.

A preferred embodiment of the first coupling piece and of a matching handheld applicator according to the present invention is shown in the accompanying drawings, in which like elements are indicated by the same numerical reference.

In FIG. 1, in exploded view, is shown how a handheld applicator 30 according to the present invention may be coupled to a first coupling piece 1 according to the present invention, in an assembly wherein this coupling piece 1 is snapped onto the valve flange of a container, and after the integrated cap of the coupling piece is broken off to allow access to the container valve. The figure shows how the coupling piece 1 is snapped onto the container head 9. The coupling piece itself is provided with an externally threaded section 18 and a plurality of handles 12, four of them in this example, with the purposes explained above. After having broken off the integrated cap, the top of the coupling piece reveals the access to the stem 13 of the container valve, a part of one of the internal support legs 6 for supporting the valve cup, and the click-in sleeve 10 for accepting the broken off cap again for reclosing the valve compartment. As example of the element of the present invention required for the coupling with the handheld applicator is shown the first coupling means 15, in this example the two protrusions 15 provided internally to the coupling piece and located diametrically opposite to each other with respect to the position of the valve of the container in the assembly with the container.

FIG. 1 also shows, above the first coupling piece, a handheld applicator 30 in a position as it may have been coupled to the first coupling piece 1 below it. The handheld applicator 30 comprises a fixed part 32, a moveable part 33, provided with a handle 34, and a joint 35 connecting the two parts. Safety seal 40 is blocking, by its mere presence, the movement of the moveable part 33 relative to the fixed part 32. Further shown on FIG. 1 is a connection 38 for accommodating a trunk or hose for allowing a better aim of the compound when it is applied through the handheld applicator 30. Also visible on FIG. 1 are the receiving device 36, the conveying tube 37, the shoulder 41 thereof and the membrane 39 connecting it to the receiving device and the fixed part 32, and a part of the second complementary cooperating means 31 which are provided as part of the handheld applicator 30 for cooperating with the means 15 and coupling with the coupling piece 1.

Figure 2:
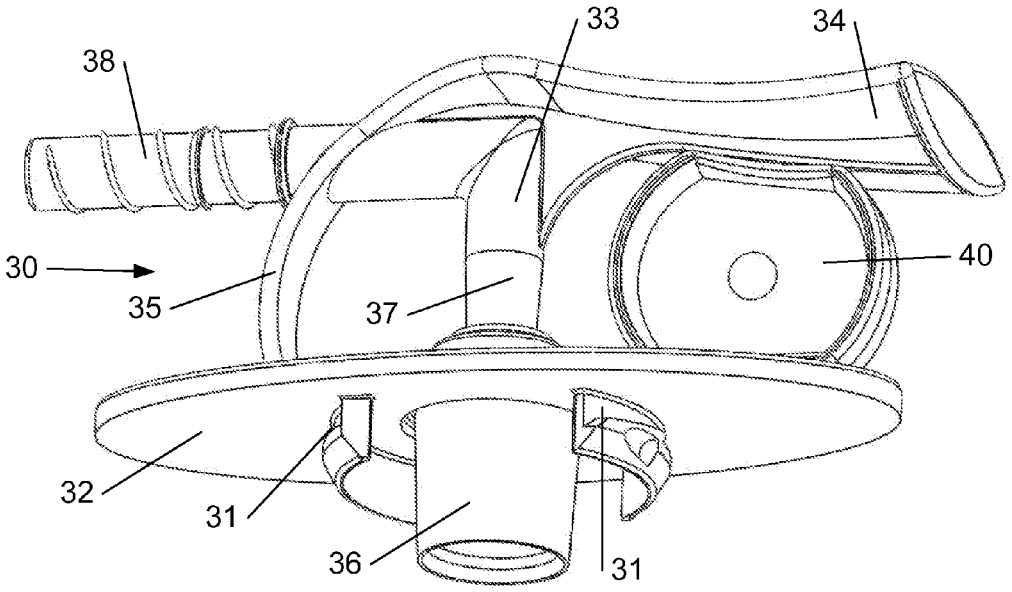
FIG. 2 shows the same handheld applicator as in FIG. 1 from a bottom perspective.

The bottom perspective of the handheld applicator of FIG. 1 is shown in FIG. 2. It shows more clearly the grooves 31 which are provided as part of the fixed part 32 of the handheld applicator 30 for coupling with the coupling piece 1 by cooperating with the protrusions 15. The coupling is supposed to bring the receiving device 36 into the correct position around the container valve 3. Further shown in FIG. 2 are the moveable part 33 of the handheld applicator, comprising a handle 34, the conveying tube 37 and the connection 38. The moveable part 33 is connected to the fixed part 32 by joint 35. The position of the moveable part 33 relative to the fixed part 32 is secured by the safety seal 40.

Figure 3:
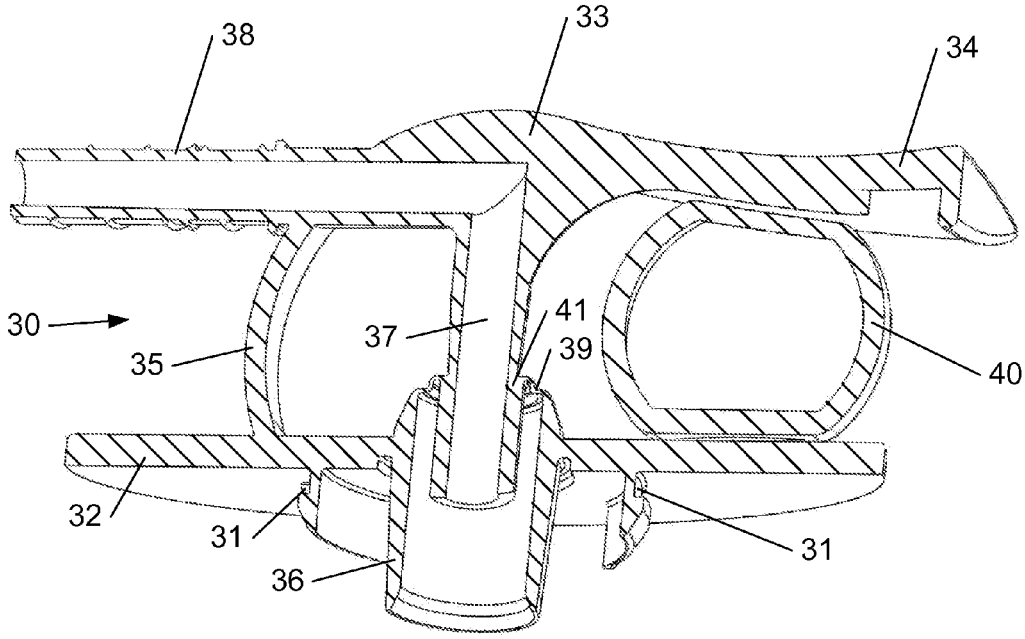
FIG. 3 shows a perspective view of one half of the same handheld applicator as in FIGS. 1 and 2, cut off by a plane through the axes of symmetry of the conveying tube and the receiving device.

FIG. 3 provides a better view of the internals of the handheld applicator. It shows in perspective view a cross-section of the handheld applicator of FIGS. 1 and 2, cut off by a plane through the axes of symmetry of the conveying tube and the receiving device. Moveable part 33 is clearly recognized, with its handle 34, the conveying tube 37 and the connection 38, with its shoulder 41 connected by membrane 39 to the top of the hollow cylinder 36 which represents the receiving device. Also visible is the connection 35, which should be flexible, between the fixed part 32 and the moveable part 33 of the handheld applicator, and which functions as the joint, or hinge joint to allow the respective movement of the two parts after the removal of the safety seal 40 by breaking this away.

In FIG. 3, as example of the element of the present invention required for the coupling of the handheld applicator with the coupling piece, is shown the second coupling means 31, in this example the two grooves 31 provided externally to the handheld applicator and located diametrically opposite to each other with respect to the position of the valve of the container in the assembly with the container and with the coupling piece. The grooves have a wider opening for ease of access for the protrusions 15, and taper more narrow towards their end or stop.

Figure 4:
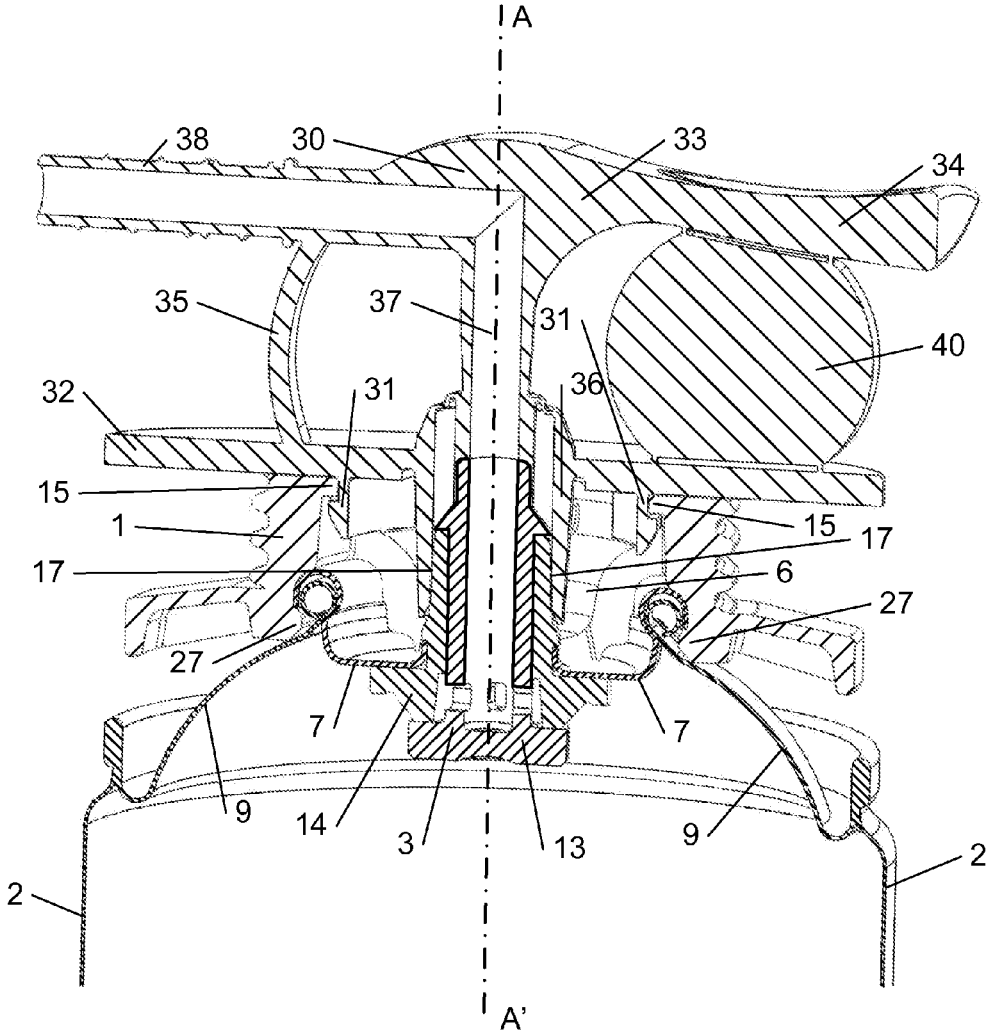
FIG. 4 shows a perspective view of one half of an assembly of a container with the first coupling piece further comprising the handheld applicator of FIGS. 1, 2 and 3, all cut off by the same plane as in FIG. 3.

FIG. 4 shows a perspective view of one half of a full assembly of a container 2 with the first coupling piece 1 further coupled with the handheld applicator 30 as shown in FIGS. 1, 2 and 3. All elements of the assembly are cut off by the same cutting plane as in FIG. 3.

As part of the container, FIG. 4 shows how the container head 9 is flanged onto the container 2 itself by a flange. It further shows how the valve cup 7 is flanged to the container head 9. The valve cup 7 supports the rubber grommet 14, which surrounds the rigid valve stem 13, and together these three components 7, 13 and 14 are composing the container valve 3. Further details in FIG. 4 reveal the internals of the valve 3, which is preferably rigid and in the case of a conventional valve, as shown, typically has a central duct which turns, just before the stem ends at its lower end in a blind flange, sideways into one or more, typically four, side openings. All is shown in its state at rest, wherein the rubber grommet 14 pulls the blind flange up against the bottom of the grommet and seals off the openings from access by the container contents.

Concerning the coupling piece 1, are showing the protruding rim 27 which is snapped onto the collar of the flange between the valve cup 7 and the container head 9, the cup usually being "shrunk" onto the head by also pushing the valve cup outwards, and which provides the attachment of the coupling piece 1 to the container 2. FIG. 4 further shows how the internal support legs 6 of the coupling piece 1 engage with the valve cup 7 of the container and secure its position against the internal pressure that may be built up inside the container.

FIG. 4 further shows how protrusions 15 grip into and have been secured into grooves 31 of the handheld applicator 30, assuring a good coupling between the handheld applicator 30 with the coupling piece 1.

Concerning the handheld applicator 30 in FIG. 4, are shown the fixed part 32, the joint 35, and the moveable part 33, with handle 34 and connection 38 and conveying tube 37 sitting on the valve stem 13 of the container valve 3, ready for pushing the valve stem 13 down when the handle 34 is pushed down, after having broken off the safety seal 40. The vertical movement of the stem 13 compresses the grommet 14 and balloons it horizontally and sideways, thereby assuring the seal 17 between the grommet and the hollow cylinder 36 which composes the receiving device of the fixed part 32.

Figure 5:
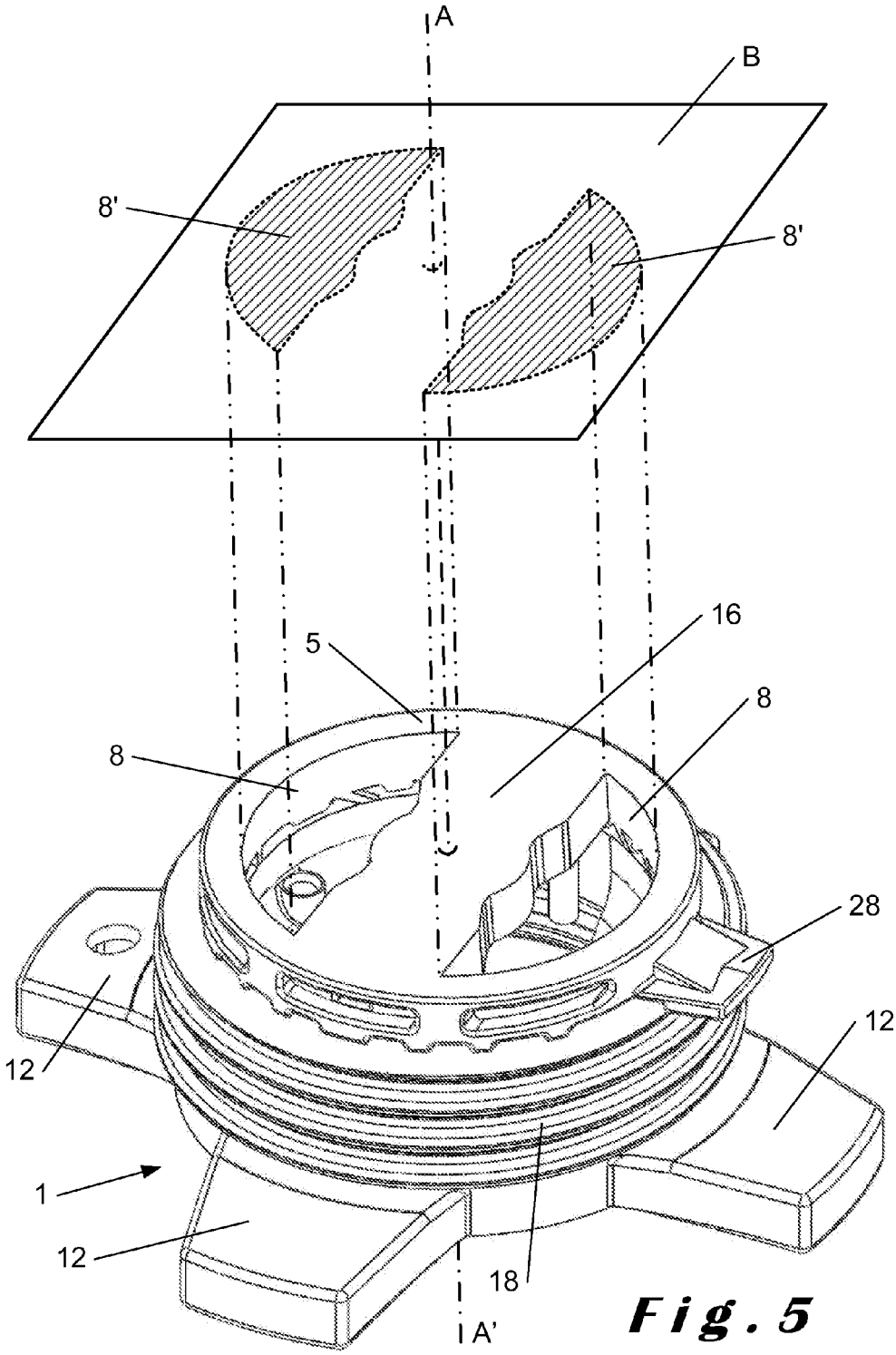
FIG. 5 shows a top perspective view of a coupling piece according to the present invention, ready to be snapped onto the valve flange of a container and with the integrated cap in the original position as made by injection moulding.

FIG. 5 shows a top perspective view of a first coupling piece according to the present invention, ready to be snapped onto the valve flange of a container and with the integrated cap in the original position as made by injection moulding. Shown are the external threaded section 18 and the handles 12 provided on the coupling piece. As part of the cap 5 are visible the open segments 8, the flat surface 16 and the cap lip 28.

Figure 6:
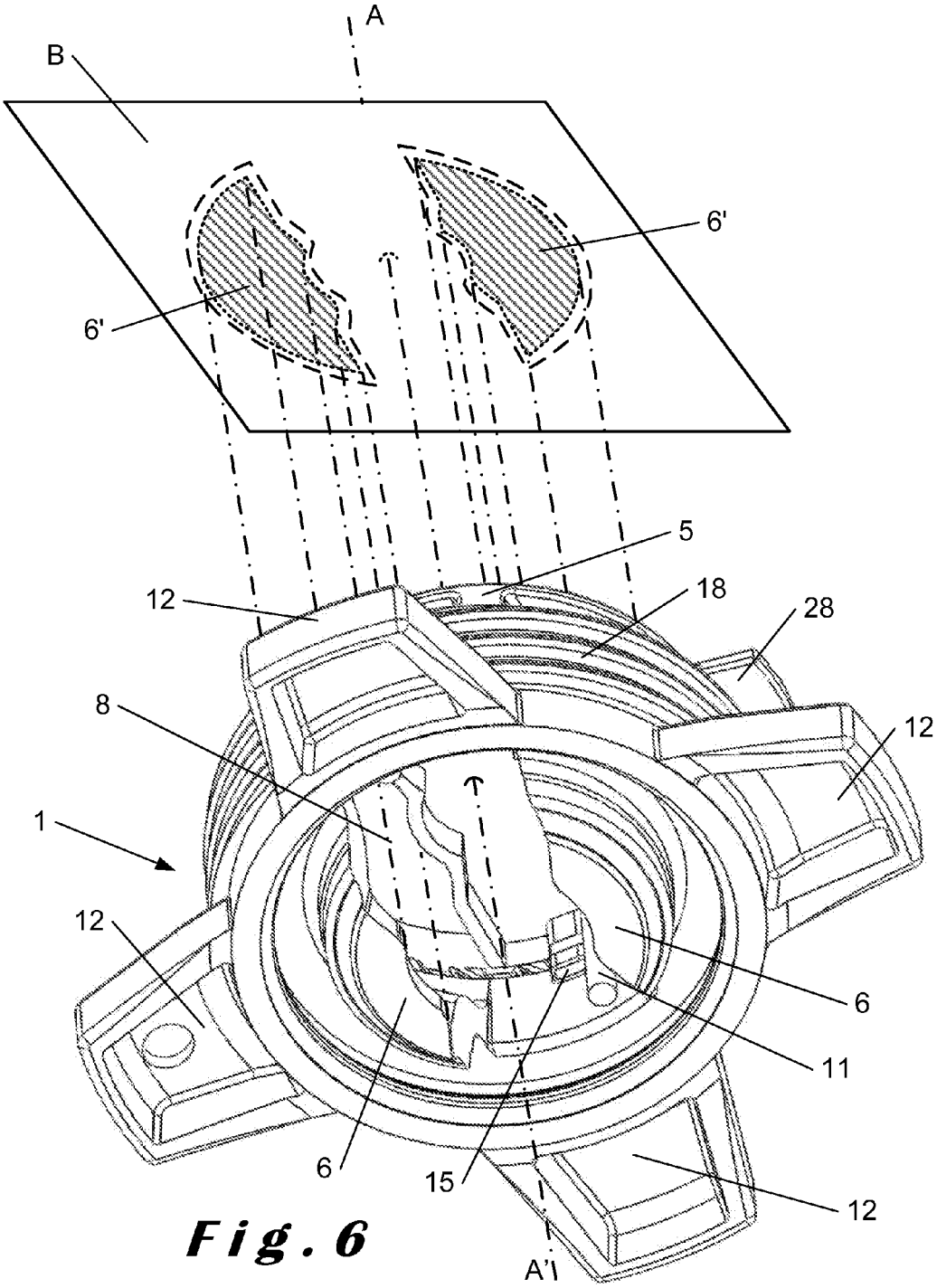
FIG. 6 shows a bottom perspective view of the coupling piece of FIG. 5.

FIG. 6 shows a bottom perspective view of the coupling piece of FIG. 5. Again showing are the external threaded section 18 and the handles 12, as well as a part of the cap 5 with its cap lip 28. This drawing provides a good view of the internal support legs 6 provided internally to the coupling piece for securing the valve cup into its original position despite a pressure buildup inside the container after snapping on the first coupling piece. Also visible are one of the open segments 8 in the integrated cap, as well as one of the clicking-in legs 11 provided for enabling a replacing of the cap 5 after breaking it off, back onto the coupling piece by cooperation with the means 10.

Figure 7:
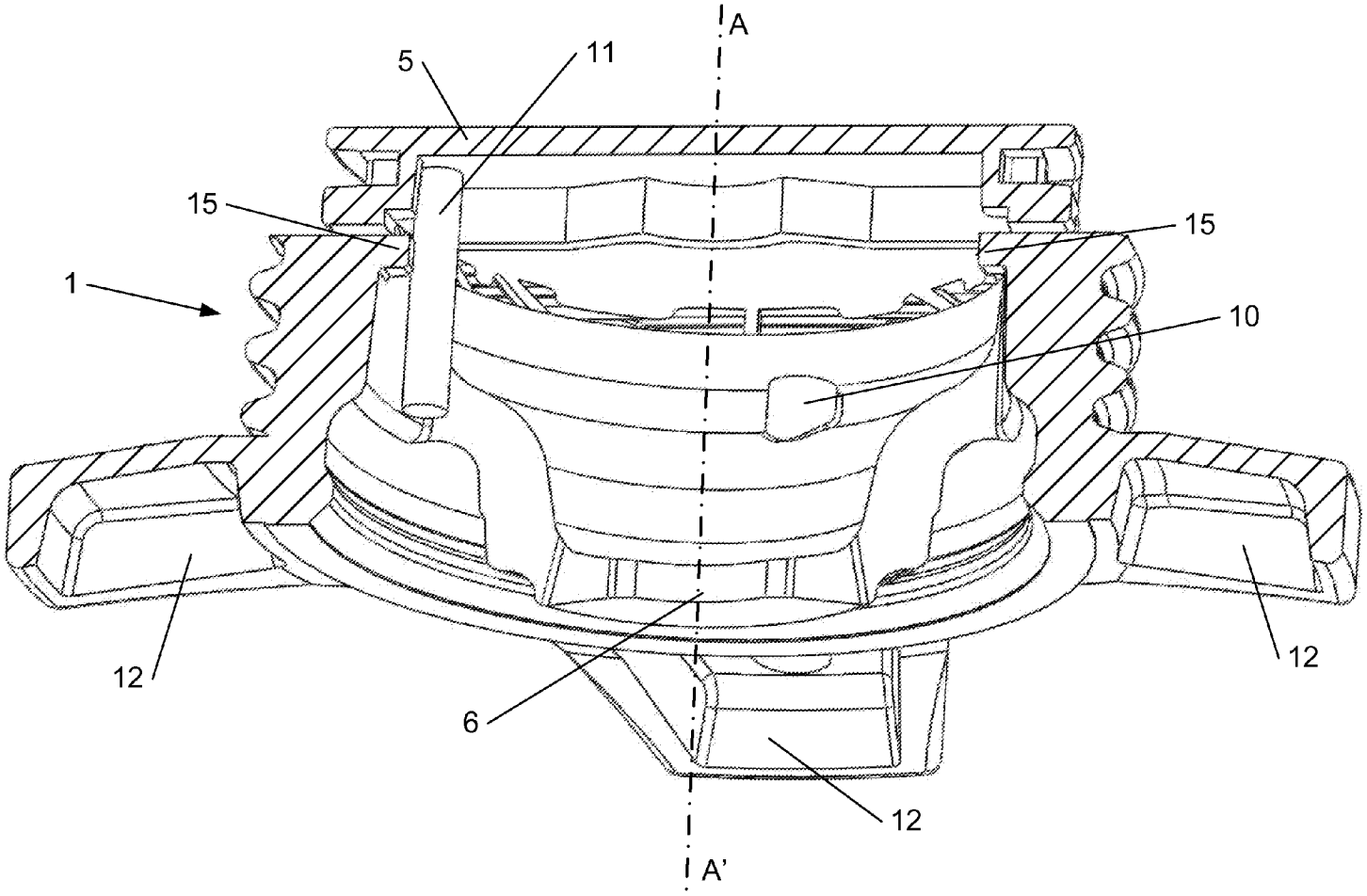
FIG. 7 shows in bottom perspective half of the coupling piece of FIGS. 5 and 6, cut off by a plane through the central symmetry axis of the coupling piece and also cutting through the pins internal to the coupling piece and located diametrically opposite to each other.

The bottom perspective view of the half of the coupling piece of FIGS. 5 and 6, as shown in FIG. 7, shows a full view of an internal support leg 6, with sleeve 10 integrated into it, and of clicking-in leg 11 provided at the underside of the cap 5. The drawing also shows handles 12 and pins 15 provided as part of the coupling piece 1.

Figure 8:
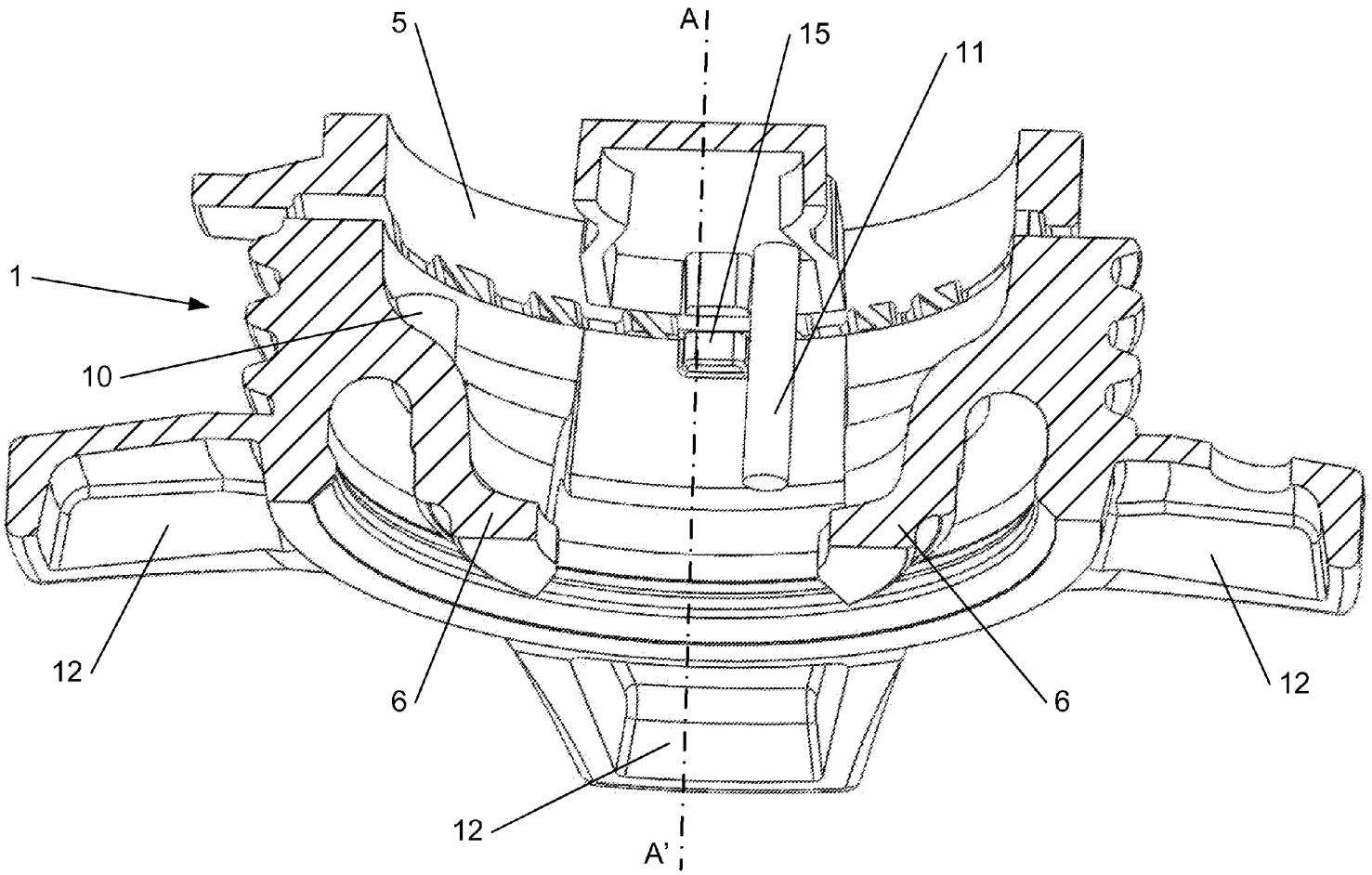
FIG. 8 shows in bottom perspective another half of the coupling piece of FIGS. 5 and 6, cut off by a plane through the central symmetry axis of the coupling piece but now perpendicular to the cutting plane of FIG. 7.

FIG. 8 shows a cut perpendicular to this in FIG. 7, and provides a good view of two opposing internal support legs 6, a full view of a pin 15 internal to the coupling piece 1.

Figure 9:
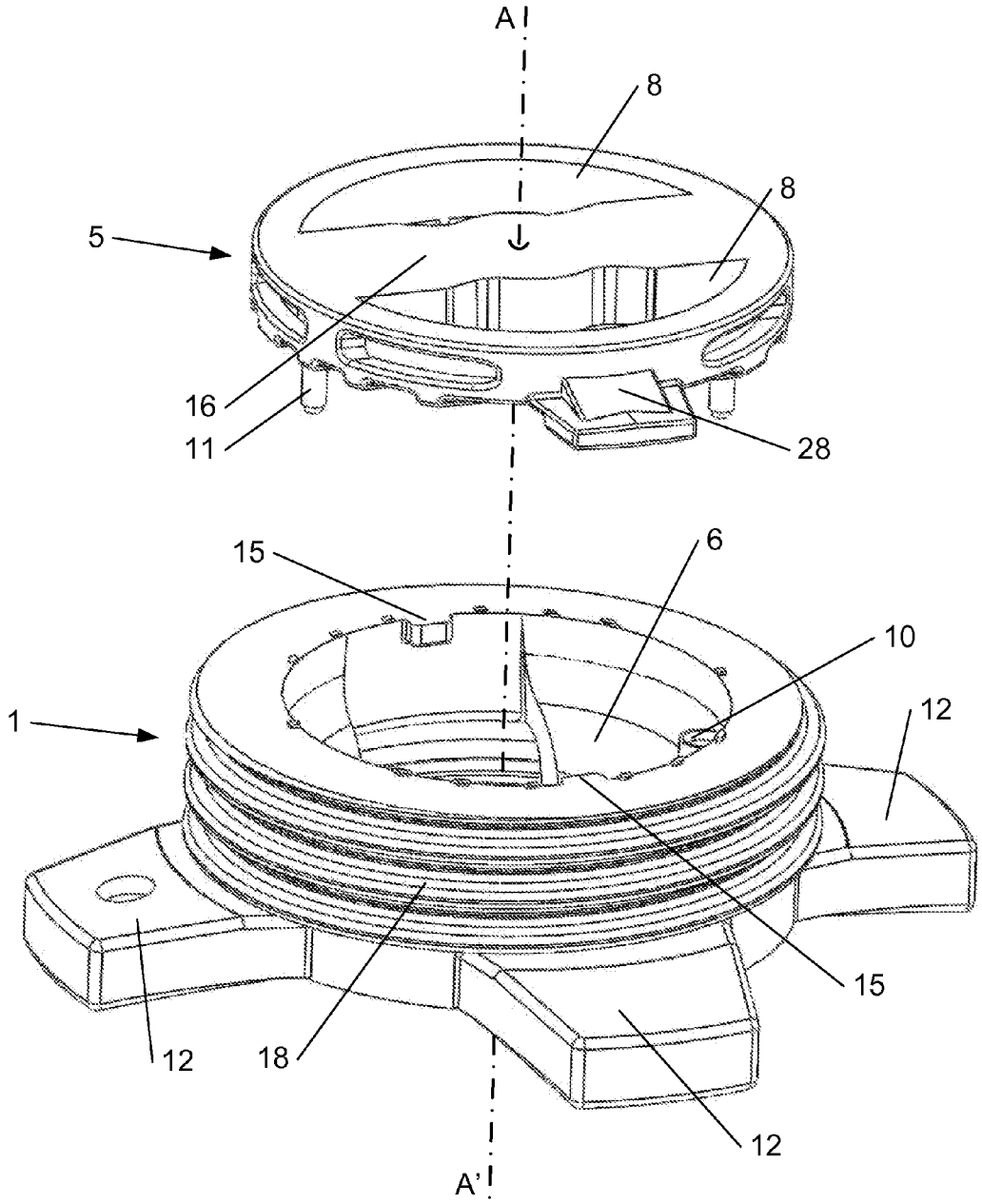
FIG. 9 shows the coupling piece of FIGS. 5 and 6, with the cap broken off and in exploded position, with the cap turned 90° around a vertical axis, in a position ready for reclosing the cap onto the coupling piece.

FIG. 9 shows how the integrated cap 5 may be broken off from the coupling piece 1 of FIGS. 5 and 6, and turned 90° around a vertical axis, in a position ready for reclosing the cap 5 onto the coupling piece 1.

Figure 10:
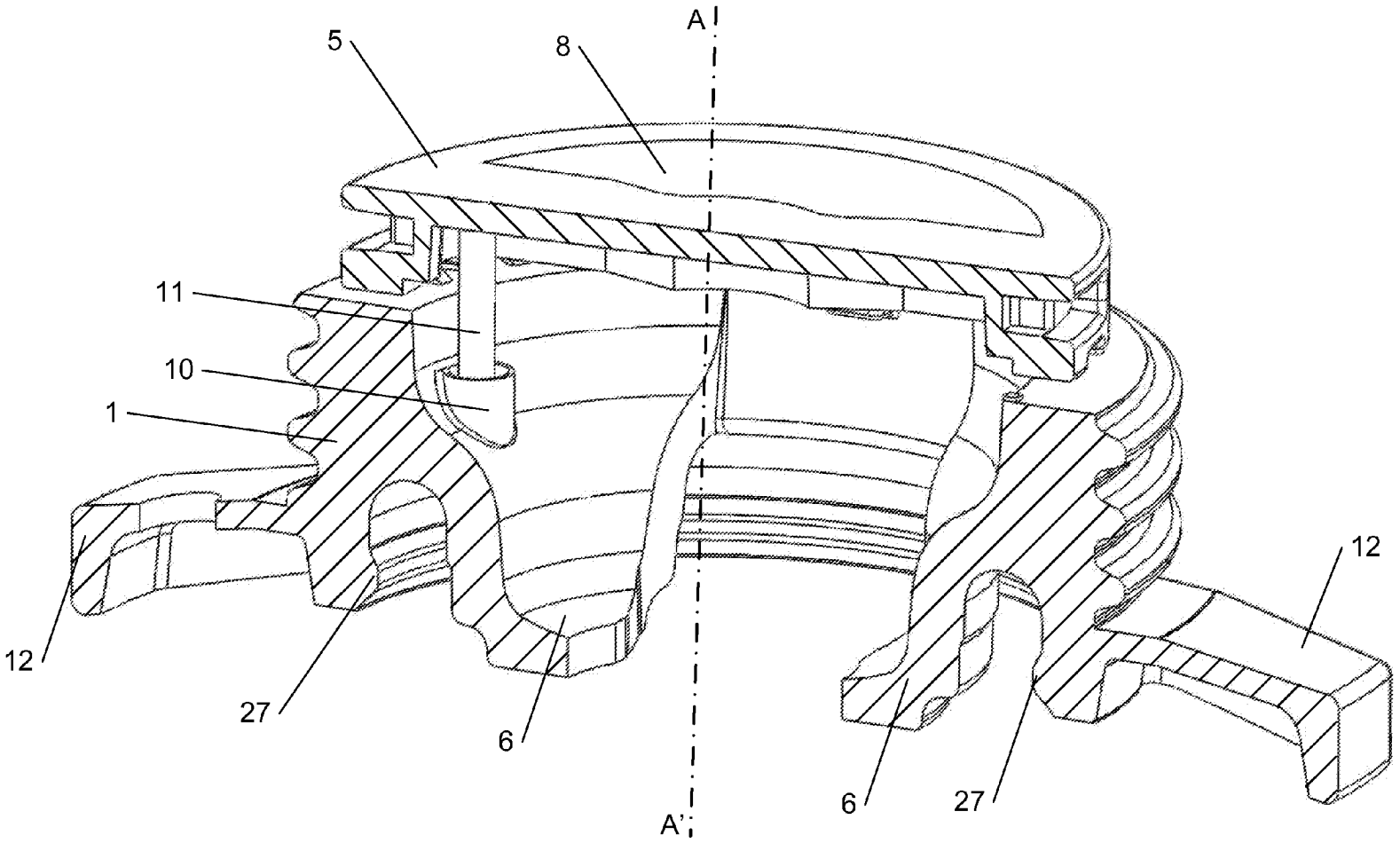
FIG. 10 is similar to FIG. 8 but shows the cap replaced onto the coupling piece for reclosing the valve compartment.

FIG. 10 shows how the cap 5 may be replaced onto the coupling piece 1 for reclosing the valve compartment. The two clicking-in legs 11 provided at opposite sides of the cap (one shown) are clicked into sleeves 10 (one shown), which are also provided as part of the internal support legs 6, of which the function has been explained before. The same applies to features 8, 12 and 27 on FIG. 10.

Having now fully described this invention, it will be appreciated by those skilled in the art that the invention can be performed within a wide range of parameters within what is claimed, without departing from the spirit and scope of the invention. As understood by those of skill in the art, the overall invention, as defined by the claims, encompasses other preferred embodiments not specifically enumerated herein.

The invention claimed is:

1. An assembly of a first coupling piece attached to a container which coupling piece is provided with an externally threaded section suitable for providing a screw coupling, the container comprising a valve for closing off the container, the valve comprising a valve stem surrounded by a valve cup which is flanged to the container head, whereby the valve of the container is provided for being opened during effectuation of the screw coupling, whereby the first coupling piece is further provided with at least one first means suitable for coupling with a handheld applicator for applying the component present in the container, which coupling with the handheld applicator is suitable, in an assembly of the container with the first coupling piece attached, together with the handheld applicator, for enabling the opening of the valve of the container by an action on the handheld applicator, whereby the at least one first means suitable for coupling with the handheld applicator comprises a guide or a protrusion, the first coupling piece further comprising an internal support rim or one or more internal support legs which are providing an internal rim or sections of an internal rim which engage with the outer surface of the valve cup of the container valve, thereby providing exterior support for the valve cup for maintaining the valve stem in its original position against any pressure inside the container, whereby the first coupling piece is further comprising an integrated cap provided for being broken off manually and for requiring its removal in order to allow the opening of the container valve during effectuation of the screw coupling and an effectuation of the coupling between the first coupling piece and the handheld applicator, whereby the cap is provided with open segments and whereby the area covered by a first projection, of the open segments in the cap and made along the axis of rotation of the screw coupling and onto a plane perpendicular to this axis of rotation, comprises the area covered by a second projection, made along the same axis and onto the same plane, of the internal surfaces of the one or more internal support legs which face the axis of rotation.

2. The assembly according to claim 1 whereby the first means suitable for providing the coupling between the coupling piece and the handheld applicator comprises two protrusions internal to the coupling piece and located diametrically opposite to each other with respect to the position of the valve of the container.

3. The assembly according to claim 1 wherein the first coupling piece is further provided with at least one first element and wherein the cap is provided with at least one second element whereby the second element is provided for cooperation with the first element in order to removably reattach the cap onto the first coupling piece after it has been broken off from the coupling piece.

4. The assembly according to claim 1 further comprising a handheld applicator for applying a component present in the container, whereby the handheld applicator is provided with at least one second means for coupling with the first coupling piece as defined in claim 1, the second means being complementary cooperating with the first means provided on the first coupling piece and together being suitable for providing a coupling between the handheld applicator and the first coupling piece, and also being suitable for enabling the opening of the valve of the container by an action on the handheld applicator, wherein the second means for coupling with the first coupling piece comprises a protrusion or a guide for accepting a protrusion of the first coupling piece, whereby the protrusion is moveable within the guide between a first position and a second position, in not more than one full 360 degree turn, the first position corresponding to an uncoupled state of the coupling between the first coupling piece and the handheld applicator and a closed position of the container valve, and the second position corresponding to a coupled state of the coupling between the first coupling piece and the handheld applicator and a position of the container valve which is closed and ready to be opened by the action on the handheld applicator.

5. The assembly according to claim 4 wherein the protrusion and the guide are suitable for cooperating in a pin-and-groove connection.

6. The assembly according to claim 4 wherein the first means comprises two pins for cooperating with two grooves in the handheld applicator.

7. The assembly according to claim 4 wherein the protrusion is moveable within the guide between a first position and a second position, in not more than a 180 degree turn.

8. The assembly according to claim 7 wherein the protrusion is moveable within the guide in not more than a 90 degree turn.

9. The assembly according to claim 7 wherein the second means comprises two grooves at the outside of the handheld applicator and located diametrically opposite to each other for accepting two pins provided internally on the first coupling piece.

10. The assembly according to claim 9 wherein the grooves are having a wider opening and are tapering narrower towards their end or stop.

11. The assembly according to claim 4 wherein the handheld applicator is coupled to the first Coupling piece attached to the container.

12. The assembly according to claim 1 wherein the container contains a composition suitable for forming a silicone paste, a polyurethane (PU) foam, or a glue.

* * * * *